United States Patent [19]

Silvestri

[11] 4,089,162

[45] May 16, 1978

[54] ACCOMMODATING DEVICE FOR THERMAL TRANSIENT EXPANSIONS

[75] Inventor: Giovanni J. Silvestri, Barrington, R.I.

[73] Assignee: The United States of America as represented by the Secretary of the Navy, Washington, D.C.

[21] Appl. No.: 720,314

[22] Filed: Sep. 3, 1976

[51] Int. Cl.[2] ..... F02B 75/36; F02G 3/00

[52] U.S. Cl. ..... 123/200; 60/39.63; 60/39.32; 418/61 A

[58] Field of Search ..... 418/61 A, 61 B; 60/39.61, 39.63, 39.69, 39.32

[56] References Cited

U.S. PATENT DOCUMENTS

| | | | |
|---|---|---|---|
| 3,091,386 | 5/1963 | Paschke | 418/61 A |
| 3,687,578 | 8/1972 | White et al. | 418/61 B |
| 3,798,899 | 3/1974 | Hill | 60/39.32 |
| 3,841,801 | 10/1974 | Sturlason et al. | 418/61 B |
| 3,911,672 | 10/1975 | Irwin | 60/39.32 |

*Primary Examiner*—Robert E. Garrett

*Attorney, Agent, or Firm*—Richard S. Sciascia; Arthur A. McGill; Prithvi C. Lall

[57] ABSTRACT

An accommodating device for thermal transient expansions in an expander engine wherein a configured valve support includes a spring-nut arrangement for controlling and minimizing the force changes due to the temperature variations of the valve because of the hot gases passing therethrough. This results in a consistent valve performance.

5 Claims, 3 Drawing Figures

ACCOMMODATING DEVICE FOR THERMAL TRANSIENT EXPANSIONS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This application is co-pending with my three other patent applications; Ser. Nos. 720,313; 720,485; and 720,490 and having the same filing date of Sept. 3, 1976 and relating to a rotary expander engine of the Wankel type describing and claiming various aspects thereof.

This invention relates to accommodating devices and more particularly to an accommodating device for thermal transient expansions in an expander engine of the Wankel type.

A conical shaped hot working fluid rotary valve has been used in swashplate type torpedo engines for many years. The forces exerted between the valve's mating surfaces can vary widely as the material supporting and referencing the valve to some common ground point expands and contracts under the influence of transient temperature gradients existing from the time of starting of the engine to the time an equilibrium is reached. The variations in the forces adversely affect performance of the valve with respect to leakage or friction power loss. It is thus desirable to have a compensating system to maintain a consistent valve performance.

SUMMARY OF THE INVENTION

An accommodating device according to the teachings of subject invention comprises a spring-nut arrangement which is housed in the support assembly of an inlet valve and is referenced to a common ground. Any thermal expansions of the inlet valve and/or combustion chamber are compensated by the spring resulting in a consistent performance of the inlet valve.

An object of subject invention is to achieve a consistent performance of the inlet valve of an expander engine.

Another object of this invention is to accommodate for the thermal expansions of the inlet valve due to hot working fluid passing therethrough.

Still another object of subject invention is to accommodate for the expansions of the combustion chamber of an expander engine caused by the working fluid under high temperature and pressure produced therein or brought inside the combustion chamber from an external source.

Other objects, advantages and novel features of this invention will become apparent from the following detailed description of the invention when considered in conjunction with the accompanying drawings wherein:

DESCRIPTION OF A PREFERRED EMBODIMENT

Figure 1:
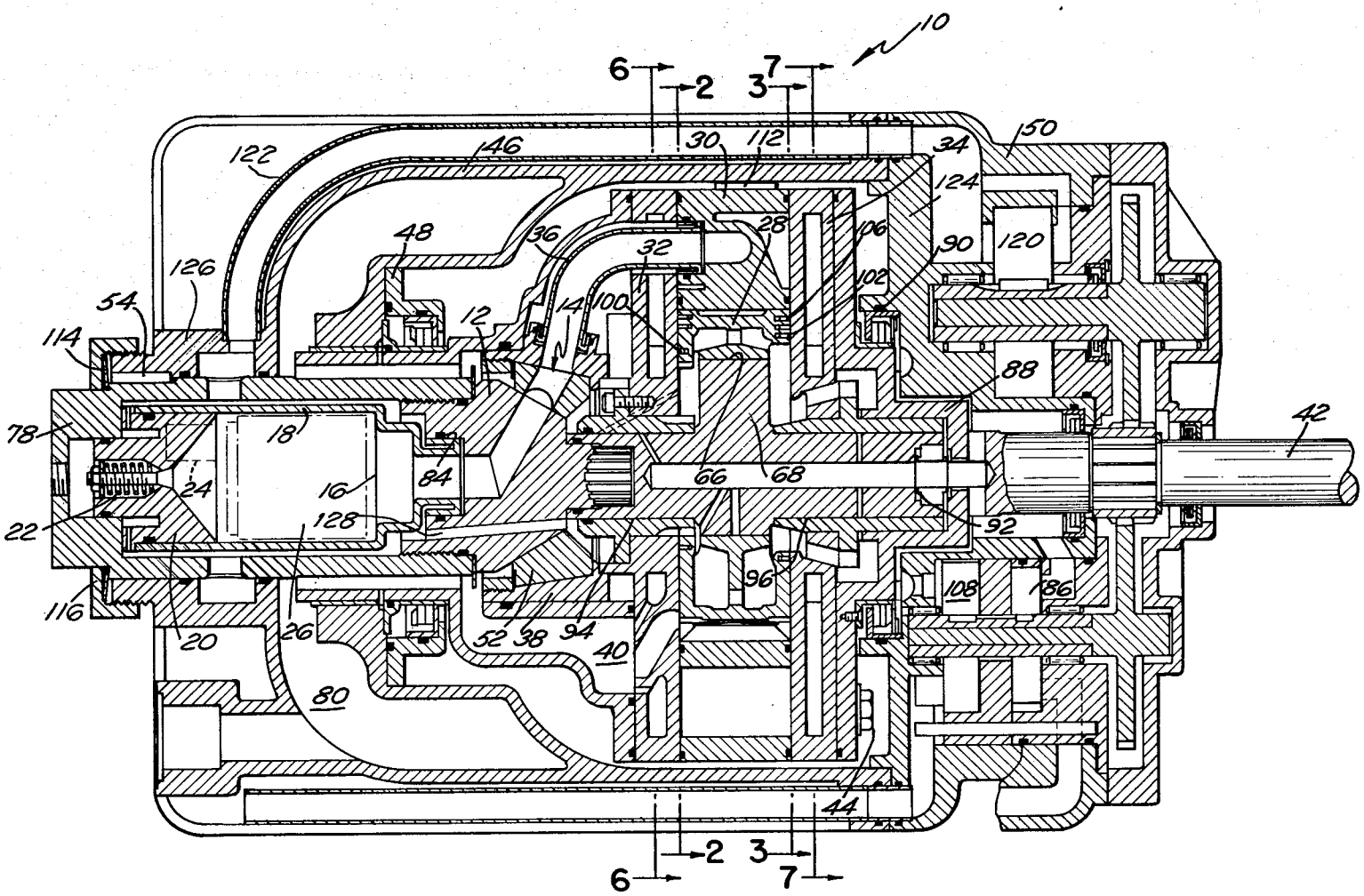
FIG. 1 is a multi-cross sectional view of an expander engine wherein an accommodating device of subject invention is used.
Figure 2:
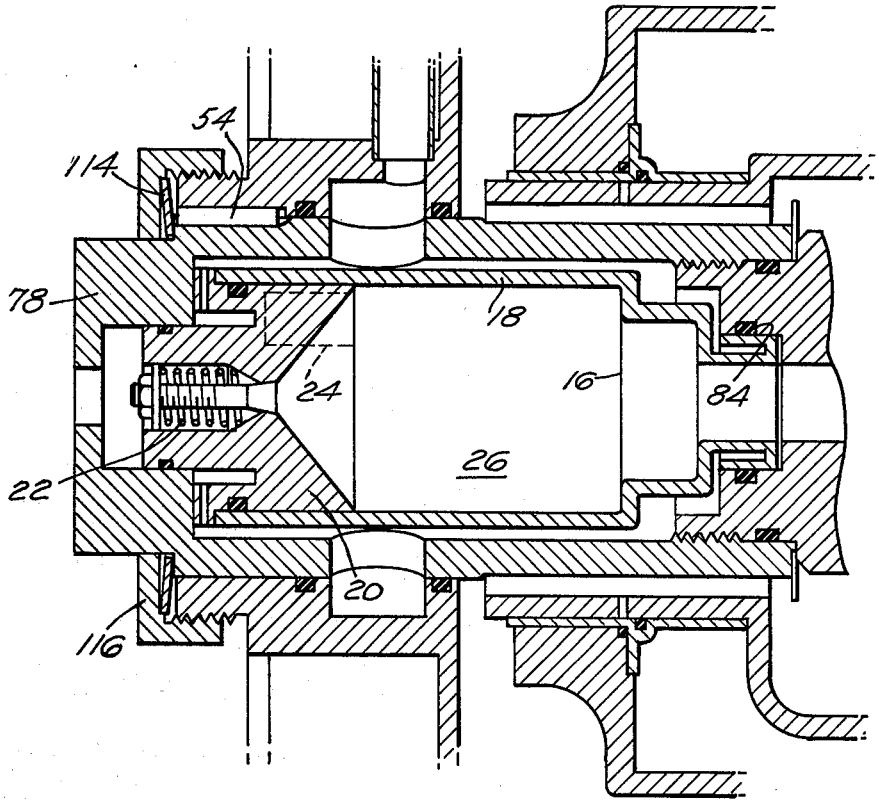
FIG. 2 is a magnified view of a part of the expander engine shown in FIG. 1 showing the spring-nut combination in a relaxed position.
Figure 3:
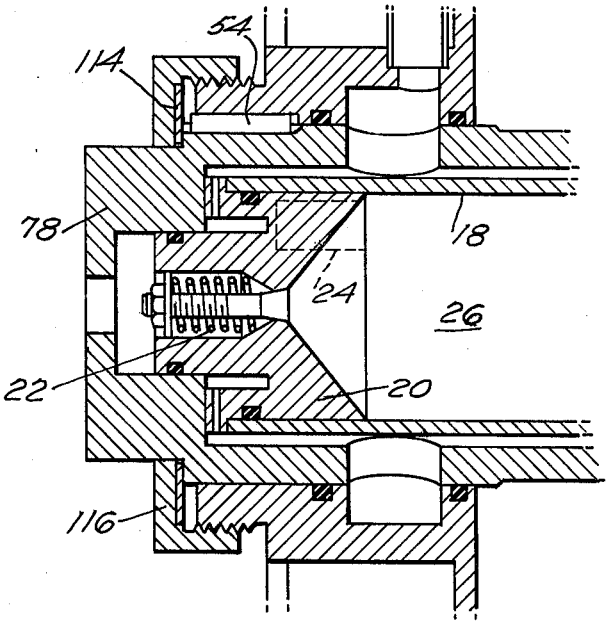
FIG. 3 is a view similar to the one shown in FIG. 2 with the spring-nut arrangement in a strained position.

Referring to the drawings wherein like reference characters designate like parts throughout the several views, and more particularly to FIG. 1 thereof, a multi-cross sectional view of expander engine 10 using an accommodating device is shown. As shown in FIG. 1, male part 12 of inlet rotary valve 14 is a part of combustion chamber 16 as housing structure 78 is screwed and locked to male part 12. The female part 52 of valve 14 is a part of the rotating assembly of expander engine 10 and is firmly fixed to rotating housing chamber 30. The rotating members are referenced to the support structure 126 through a thrust bearing. The male part 12 of inlet valve 14 is referenced to support structure 126 through a spring 114 and nut 116. Nut 116 permits changes in the normal force between the mating surfaces of male member 12 and female member 52 of inlet valve 14 while spring 114 allows changes in the axial length of the members involved, which are influenced respectively by the temperatures of hot working fluid, water and exhaust gas, with minimum change of force. Spring 114 is preferably a stacked Bellville spring and its spring constant can be changed according to the requirements of the expander engine. FIG. 2 illustrates the situation when spring 114 is in its unstrained or relaxed condition and FIG. 3 illustrates when spring 114 is in a strained condition. These figures indicate the way the spring-nut arrangements accommodate for the thermal transients of the valve and/or combustion chamber.

Briefly stated, an accommodating device to compensate transient thermal expansion in an expander engine, includes a spring-nut arrangement to which the rotating part of the inlet valve is referenced. Any changes in the dimensions of the combustion chamber or the rotating valve are compensated by the spring-nut arrangement, thus insuring consistent valve performance.

Obviously many modifications and variations of the present invention are possible in the light of the above teachings. As an example, the spring used in the accommodating may be other than a Bellville spring. Furthermore, the spring constant may be varied as required for a particular machine. It is therefore understood that within the scope of the appended claims the invention may be practiced otherwise than specifically described.

I claim:

1. An accommodating device for compensating thermal transient expansions in a rotary engine which comprises:

a housing assembly having a first end and a second end;

an elongated combustion chamber being mounted in said housing, said chamber having a first end and a second end;

a pintle valve assembly being detachably mounted to said combustion chamber at the first end thereof;

an inlet valve having a stationary male part being connected to said combustion chamber at the second end thereof and a rotatable female part being secured to the rotating members of said expander engine;

a keying means mounted in said housing assembly for providing a reference ground for said expander engine;

a nut member being demountably engaged to said housing assembly at the first end thereof; and a spring member being mounted between said nut member and the first end of said housing assembly and said spring member being in contact with said combustion chamber.

2. The accommodating device of claim 1 wherein said spring is a Bellville spring.

3. The accommodating device of claim 2 wherein said combustion chamber has a liner mounted therein along the walls thereof.

4. The accommodating device of claim 2 wherein said expander engine further includes a rotatable housing chamber and a rotatable rotor being attached to the rotatable male part of said inlet valve.

5. The accommodating device of claim 2 wherein said expander engine further includes a stationary crank shaft mounted thereon.

* * * * *